United States Patent [19]

Cunningham et al.

[11] Patent Number: 4,900,897

[45] Date of Patent: Feb. 13, 1990

[54] SHEATHED ELECTRIC HEATING ELEMENT ASSEMBLY

[75] Inventors: Donald M. Cunningham, Pittsburgh, Pa.; Mark A. Bartels, Rockford, Ill.; T. Randall Markum, Vernon, Ala.

[73] Assignee: Emerson Electric Co., St. Louis, Mo.

[21] Appl. No.: 273,291

[22] Filed: Nov. 21, 1988

[51] Int. Cl.[4] ..... H05B 3/48

[52] U.S. Cl. ..... 219/336; 219/331; 219/523

[58] Field of Search ..... 219/336, 316, 318, 331, 219/517, 523; 338/238

[56] References Cited

U.S. PATENT DOCUMENTS

| | | | |
|---|---|---|---|
| 1,911,063 | 5/1933 | Daly | 338/238 |
| 2,854,556 | 9/1958 | McOrlly | 338/238 |
| 4,156,128 | 5/1979 | Craven | 219/523 |
| 4,390,776 | 6/1983 | Yane et al. | 219/523 |
| 4,697,069 | 9/1987 | Bleckmann | 219/517 |

FOREIGN PATENT DOCUMENTS 2098436 11/1982 United Kingdom ..... 219/331

*Primary Examiner*—A. D. Pellinen
*Assistant Examiner*—Geoffrey S. Evans
*Attorney, Agent, or Firm*—Polster, Polster and Lucchesi

[57] ABSTRACT

In a metallic sheathed electric heating element assembly having a resistance element, a sheath surrounding the resistance element, pulverulent electrically insulating material within the sheath and surrounding the resistance element, the insulating material being tightly compacted and extending within the sheath short of an open end thereof, and a terminal pin electrically and mechanically connected to an end of the resistance element within the compass of the sheath, the terminal pin is made in two parts, an inner part to which the resistance element is connected, and an outer part spaced from the inner part, and a thermal switch or cut off electrically connected to and in series between the inner and outer parts of the pin within the sheath but spaced toward the open end from the compacted insulating material, the thermal switch being in good thermal contact with the inner part of the terminal pin.

3 Claims, 1 Drawing Sheet

SHEATHED ELECTRIC HEATING ELEMENT ASSEMBLY

BACKGROUND OF THE INVENTION

The heating element assembly of this invention can be used in the same environment and for the same purpose as that of the heating element assembly of U.S. Pat. No. 4,687,905, dated Aug. 18, 1987, which issued to the same inventors, and can be formed in the same shape and equipped with the same kind of terminal block, although the terminal block used with the heating element assembly of this invention can be of simpler construction. Its use is not limited to that application, however. In the assembly of U.S. Pat. No. 4,687,905, a separate container or well was provided to house a thermal cut off assembly. This arrangement works well, but it is somewhat expensive and requires some additional wiring.

Attempts to house a thermal cutoff assembly within the sheath of a metallic sheathed electric heating element have heretofore been unsuccessful, because it has been thought that in order to get good thermal contact, it was necessary to position the thermal cutoff in contact with the pulverulent electrically insulating material that surrounds the resistance element. When that material was compacted, as it must be, the thermal cutoff assembly was damaged.

It has been discovered that if a two piece terminal pin is provided and the thermal cutoff assembly is positioned intermediate two sections of the terminal pin, within the compass of the sheath but spaced from the pulverulent insulating material, the sheath can be drawn down to compact the insulating material without damaging the thermal cutoff assembly, and at the same time, the thermal cutoff assembly will receive sufficient heat from the end of the section of pin to which the resistance element is connected, within the sheath, and, under overheating conditions, from the sheath itself, to provide an effective cutoff of the current to the resistance element if the heating element overheats, as in response to the running dry of a water heater tank, for example.

One of the objects of this invention is to provide a metallic sheathed electric heating element assembly, effectively protected by a thermal cutoff assembly, that is simpler, demands less space, and is more versatile than heating assemblies incorporating a thermal cutoff known heretofore.

Other objects will become apparent to those skilled in the art in the light of the following description and accompanying drawing.

SUMMARY OF THE INVENTION

In accordance with this invention, generally stated, in a metallic sheathed electric heating element assembly having a resistance element, a sheath surrounding the resistance element, pulverulent electrically insulating material within the sheath and surrounding the resistance element, the insulating material being tightly compacted and extending within the sheath short of an open end thereof, the terminal pin is made in two parts. An inner part of the terminal pin is electrically connected to the resistance element in the conventional way at one end, and is electrically and mechanically connected, in good heat transfer relation, to a thermal switch. An outer end part of the terminal pin is electrically and mechanically attached to another lead of the thermal switch, in series with the inner end part. The thermal switch is within the sheath, but spaced toward the open end of the sheath from the compacted insulating material.

In the preferred embodiment, the thermal switch is in the form of a thermal cutoff, and is housed in a sleeve closed at both ends by silicone bushings of a diameter greater than the thermal cutoff, mounted on leads projecting axially from the thermal cutoff. The leads on the thermal cutoff are mounted in blind passages or sockets formed axially in the two terminal sections. An inner ceramic bushing, mounted on the inner terminal pin sections, spaces the thermal cutoff assembly from he pulverulent insulating material.

DESCRIPTION OF THE PREFERRED EMBODIMENT

Figure 1:
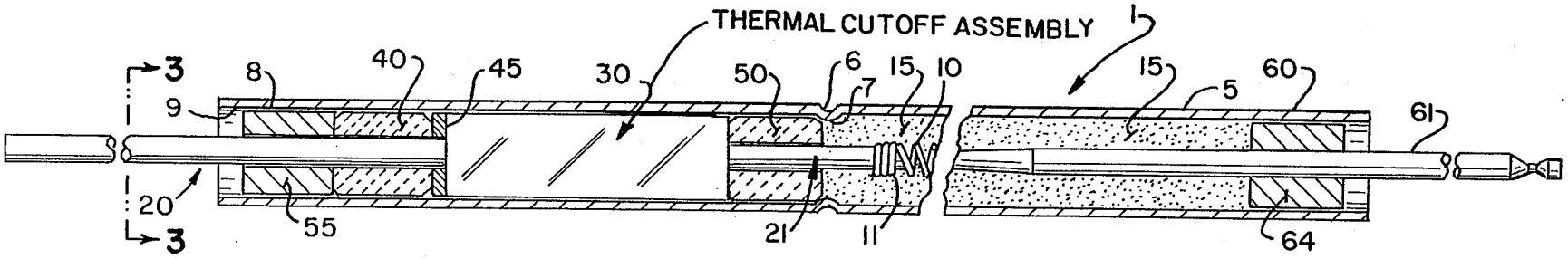
FIG. 1 is a longitudinally sectional view of a heating element assembly of this invention.
Figure 2:
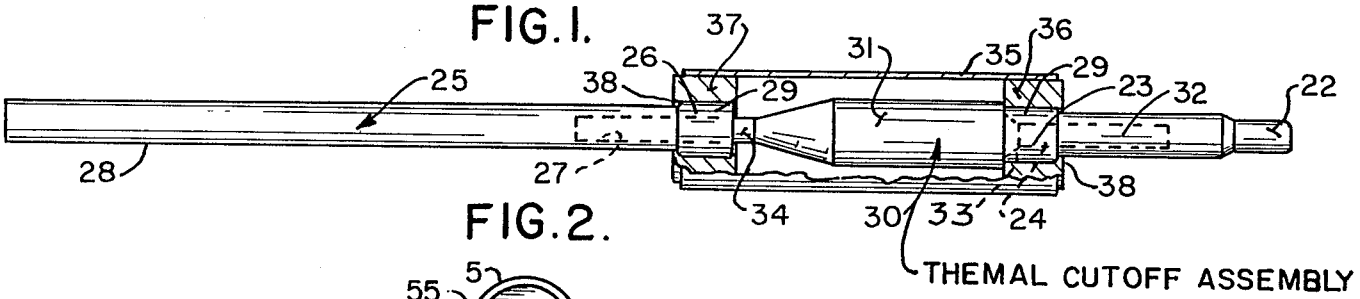
FIG. 2 is a view in side elevation partly broken away and partly in section of the terminal pin and thermal switch assembly shown in FIG. 1.
Figure 3:
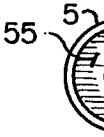
FIG. 3 is a view in end elevation taken along the line 3—3 of FIG. 1.
Figure 7:
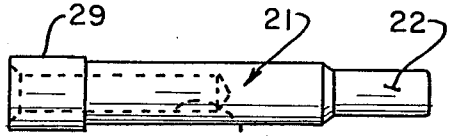
FIG. 7 is a view in side elevation of another part of the terminal pin.
Figure 6:
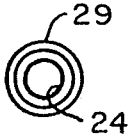
FIG. 6 is a view in end elevation viewed from left to right of FIG. 7.
Figure 5:
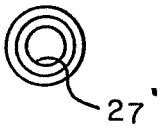
FIG. 5 is a view in end elevation looking from right to left of FIG. 4.
Figure 4:
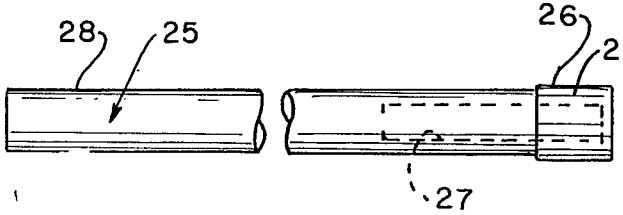
FIG. 4 is a view in side elevation, shortened and somewhat enlarged, of a part of the terminal pin.

Referring now to the drawings for one illustrative embodiment of sheathed electric heating element assembly of this invention, reference numeral 1 indicates a completed assembly, ready for mounting or for bending into a desired shape, as in the water heater immerson heating element shown in U.S. Pat. No. 4,687,905.

The heating assembly 1 has a sheath 5, within which is a conventional resistance element 10, a terminal pin 20, made in two parts, and a thermal cutoff assembly 30 therein.

The sheath 5 has a rolled channel 6, producing an internal annular shoulder 7, near a thermal cutoff end of the sheath, which terminates in an opening 9.

The terminal pin 20 has an inner part 21 with a reduced inner end 22 and an outer end 23 within which a blind passage 24 extends axially to serve as a socket. The terminal pin also has an outer part 25 with an outer part inner end 26, in which a blind passage 27 extends axially to form a socket, and an outer part outer end 28. Each of the blind passages 24 and 27 opens toward the thermal cutoff assembly 30, and is surrounded at its open end by a collar 29 integral with the respective terminal pin part.

The thermal cutoff assembly 30 includes a thermal switch or cutoff 31, with an inner lead 32 and an outer lead 34 projecting from opposite ends of the cutoff and alined axially. The thermal cutoff 31 of this embodiment has a conical inner end 33. The inner lead 32 is secured, by crimping of the pin, in the passage or socket 24 in intimate electric and thermal contact with the wall defining the passage. The pin part 21 is countersunk at the open mouth of the passage 24 in a configuration complementary to the configuration of the inner end 33 of the thermal cutoff 31, and the surface defining the countersink is in intimate thermal contact with the end surface of the thermal cutoff. The outer lead 34 is mounted in the passage or socket 27 in intimate electrical contact with the wall defining the passage 27. The cutoff assembly also includes a sleeve 35 mounted coaxially with the cutoff 31 but spaced radially therefrom. The sleeve 35 can be made of Kapton type H or F polyimide film or its equivalent, preferably transparent enough to permit the rated temperature on the body of the thermal cutoff to be visible. The ends of the sleeve 35 are closed by silicone bushings 36 and 37, each of which has a radially inwardly extending annular flange 38 abutting an outboard edge of the collar 29. The bushings 36 and 37 can also be color coded to indicate rated temperature.

A ceramic bushing 50 mounted on the inner part 21 of the terminal pin 20, rests against the shoulder 7 of the sheath, and serves to space the thermal cutoff assembly from the insulating material 15. The conventional insulating material is generally magnesium oxide powder. The diameter of the bushing 50 is at least as great as the diameter of the sleeve 35.

A fiber washer 45, mounted on the outer part 25 contiguous the outboard surface of the bushing 37 spaces the thermal cutoff from a ceramic bushing 40, and tends to insulate the cutoff thermally from the elements on the outboard side of the thermal cutoff. A silicone bushing 55 is also mounted on the pin section 25, outboard of the ceramic bushing 40, serving to seal the outer end of the sheath, and to hold the rest of the elements tightly between the open mouth and the shoulder 7.

The sheath 5 has an opposite end 60, in which a conventional one piece terminal pin 61 is mounted in a silicone bushing 64. The other end of the resistance element is secured electrically and mechanically to the terminal pin 61.

In assembling the heating element assembly of this invention, the thermal cutoff leads are inserted in the respective sockets of the two sections of the terminal pin and crimped securely therein. The sleeve 35 and bushings 36 and 37 are mounted, the ceramic bushing 50 is put into place, and one end of the resistance element 10 is secured to the reduced inner end 22 of the terminal pin. The other end of the resistance element is secured to the inner end of the terminal pin 61. The fiber washer 45, ceramic bushing 40 and silicon bushing 55 are mounted on the terminal pin 20, and the entire assembly is mounted through the open end 9.

The sheath is now stood on end vertically with the outer end of the terminal 61 projecting from the end 60 of the sheath, and centered, and the pulverulent insulating material introduced through the length of the sheath from the bushing 50 to the bushing 64, in the conventional way. The bushing 64 is put into place, and the sheath is rolled to compact the insulating material.

The thermal cutoff assembly is protected against damage by the various bushings on either side of the thermal cutoff. As has been explained, the heat conducted by the terminal pin part 21 to the end of the thermal cutoff and the lead 32, together with the heat conducted by the sheath itself to the area in which the thermal cutoff is positioned within the sheath has been found to be sufficient to activate the thermal cutoff under conditions of overheating of the sheathed heating element, to give the desired protection. The thermal cutoff can be and preferably is of the type sold under the trademark MICROTEMP, series 9XXX, a product of Therm-O-Disc, Incorporated.

It will be seen that the heating element assembly of this invention permits the use of a simple terminal block, with only two terminal pins projecting, while at the same time, it affords the protection desired.

Numerous variations in the construction of the device of this invention, within the scope of the appended claims, will occur to those skilled in the art in the light of the foregoing disclosure. By way of example, the thermal switch can be differently configured, and can even be made for over current protection. However, the latter does not pose the heretofore unsolved problems of the over temperature switch. As has been indicated, the sheathed heating element can be made of any configuration, including a compound bend arrangement as illustrated in U.S. Pat. No. 4,687,905. These are merely illustrative.

We claim:

1. In a metallic sheathed electric heating element assembly having a resistance element, a sheath surrounding said resistance element, pulverulent electrically insulating material within said sheath and surrounding said resistance element, said insulating material being tightly compacted and extending within said sheath short of an open end thereof, and a terminal pin electrically and mechanically connected to an end of said resistance element within the compass of said sheath, said resistance element contiguous its place of attachment to said pin being surrounded by said compacted insulating material, the improvement comprising said pin having an inner part to which said resistance element is connected, and an outer part spaced from said inner part, and a thermal switch electrically connected to and in series between said inner and outer parts, within said sheath but spaced toward said open end from said compacted insulating material, bushings adjacent ends of said thermal switch, said bushings being of a diameter greater than that of the thermal switch, and a sleeve surrounding said bushings and said thermal switch.

2. The improvement of claim 1, wherein said sheath is provided with an integral radially inwardly extending annular shoulder between said bushing and said resistance element.

3. The improvement of claim 1, wherein the thermal switch is a thermal cutoff, an inner end of which is conical, and the inner terminal pin part has an axial passage with a complementarily configured countersink-defining surface secured in intimate thermal transfer relation to said thermal cutoff inner end.

* * * * *